US009590308B2

(12) United States Patent
Leppaluoto

(10) Patent No.: US 9,590,308 B2
(45) Date of Patent: Mar. 7, 2017

(54) REDUCED SURFACE AREA ANTENNA APPARATUS AND MOBILE COMMUNICATIONS DEVICES INCORPORATING THE SAME

(71) Applicant: Pulse Electronics, Inc., San Diego, CA (US)

(72) Inventor: Timo Leppaluoto, Suzhou (CN)

(73) Assignee: Pulse Electronics, Inc., San Diego, CA (US)

( * ) Notice: Subject to any disclaimer, the term of this patent is extended or adjusted under 35 U.S.C. 154(b) by 168 days.

(21) Appl. No.: 14/558,562

(22) Filed: Dec. 2, 2014

(65) Prior Publication Data

US 2015/0200462 A1 Jul. 16, 2015

Related U.S. Application Data

(60) Provisional application No. 61/911,418, filed on Dec. 3, 2013.

(51) Int. Cl.
*H01Q 1/24* (2006.01)
*H01Q 9/04* (2006.01)
(Continued)

(52) U.S. Cl.
CPC ..... *H01Q 9/0414* (2013.01); *H01Q 1/243* (2013.01); *H01Q 5/371* (2015.01); *H01Q 9/42* (2013.01)

(58) Field of Classification Search
CPC ..... H01Q 1/243; H01Q 9/0414
(Continued)

(56) References Cited

U.S. PATENT DOCUMENTS 2,745,102 A 5/1956 Norgorden
3,938,161 A 2/1976 Sanford
(Continued)

FOREIGN PATENT DOCUMENTS

CN 1316797 10/2007
DE 10104862 8/2002
(Continued)

OTHER PUBLICATIONS

"An Adaptive Microstrip Patch Antenna for Use in Portable Transceivers", Rostbakken et al., Vehicular Technology Conference, 1996, Mobile Technology for the Human Race, pp. 339-343.
(Continued)

*Primary Examiner* — Hoang V Nguyen
(74) *Attorney, Agent, or Firm* — Gazdzinski & Associates, PC

(57) ABSTRACT

Space- and cost-efficient antenna apparatus and methods of making and using the same. Antenna may comprise one or more planar radiator elements fabricated from an electrically conductive material. Surface area of the antenna radiator metallized portion may be reduced by utilizing a crosshatch pattern. The pattern may comprise of one or more metal-free elements disposed within the outline of the radiator. The elements may be interconnected by conductive crosslinks. The antenna may be coupled to radio electronics at one or more connection points. At least one of a size and/or a placement of the crosslinks may be configured based on distance from the connecting points. Crosslink size and/or placement may be configured to provide a prescribed current flow within the antenna. Reducing surface area of the antenna radiator may reduce manufacturing time and/or cost compared with prior art antenna design approaches.

20 Claims, 7 Drawing Sheets

(51) Int. Cl.
*H01Q 9/42* (2006.01)
*H01Q 5/371* (2015.01)

(58) Field of Classification Search
USPC ..... 343/702, 895
See application file for complete search history.

(56) References Cited

U.S. PATENT DOCUMENTS

| | | | |
|---|---|---|---|
| 4,004,228 | A | 1/1977 | Mullett |
| 4,028,652 | A | 6/1977 | Wakino et al. |
| 4,031,468 | A | 6/1977 | Ziebell et al. |
| 4,054,874 | A | 10/1977 | Oltman |
| 4,069,483 | A | 1/1978 | Kaloi |
| 4,123,756 | A | 10/1978 | Nagata et al. |
| 4,123,758 | A | 10/1978 | Shibano et al. |
| 4,131,893 | A | 12/1978 | Munson et al. |
| 4,201,960 | A | 5/1980 | Skutta et al. |
| 4,255,729 | A | 3/1981 | Fukasawa et al. |
| 4,313,121 | A | 1/1982 | Campbell et al. |
| 4,356,492 | A | 10/1982 | Kaloi |
| 4,370,657 | A | 1/1983 | Kaloi |
| 4,423,396 | A | 12/1983 | Makimoto et al. |
| 4,431,977 | A | 2/1984 | Sokola et al. |
| 4,546,357 | A | 10/1985 | Laughon et al. |
| 4,559,508 | A | 12/1985 | Nishikawa et al. |
| 4,625,212 | A | 11/1986 | Oda et al. |
| 4,652,889 | A | 3/1987 | Bizouard et al. |
| 4,661,992 | A | 4/1987 | Garay et al. |
| 4,692,726 | A | 9/1987 | Green et al. |
| 4,703,291 | A | 10/1987 | Nishikawa et al. |
| 4,706,050 | A | 11/1987 | Andrews |
| 4,716,391 | A | 12/1987 | Moutrie et al. |
| 4,740,765 | A | 4/1988 | Ishikawa et al. |
| 4,742,562 | A | 5/1988 | Kommrusch |
| 4,761,624 | A | 8/1988 | Igarashi et al. |
| 4,800,348 | A | 1/1989 | Rosar et al. |
| 4,800,392 | A | 1/1989 | Garay et al. |
| 4,821,006 | A | 4/1989 | Ishikawa et al. |
| 4,823,098 | A | 4/1989 | DeMuro et al. |
| 4,827,266 | A | 5/1989 | Sato et al. |
| 4,829,274 | A | 5/1989 | Green et al. |
| 4,835,538 | A | 5/1989 | McKenna et al. |
| 4,835,541 | A | 5/1989 | Johnson et al. |
| 4,862,181 | A | 8/1989 | PonceDeLeon et al. |
| 4,879,533 | A | 11/1989 | De Muro et al. |
| 4,896,124 | A | 1/1990 | Schwent |
| 4,907,006 | A | 3/1990 | Nishikawa et al. |
| 4,954,796 | A | 9/1990 | Green et al. |
| 4,965,537 | A | 10/1990 | Kommrusch |
| 4,977,383 | A | 12/1990 | Niiranen |
| 4,980,694 | A | 12/1990 | Hines |
| 5,016,020 | A | 5/1991 | Simpson |
| 5,017,932 | A | 5/1991 | Ushiyama et al. |
| 5,043,738 | A | 8/1991 | Shapiro et al. |
| 5,047,739 | A | 9/1991 | Kuokkanene |
| 5,053,786 | A | 10/1991 | Silverman et al. |
| 5,057,847 | A | 10/1991 | Vaeisaenen |
| 5,061,939 | A | 10/1991 | Nakase |
| 5,097,236 | A | 3/1992 | Wakino et al. |
| 5,103,197 | A | 4/1992 | Turunen |
| 5,109,536 | A | 4/1992 | Kommrusch |
| 5,155,493 | A | 10/1992 | Thursby et al. |
| 5,157,363 | A | 10/1992 | Puurunen |
| 5,159,303 | A | 10/1992 | Flink |
| 5,166,697 | A | 11/1992 | Viladevall et al. |
| 5,170,173 | A | 12/1992 | Krenz et al. |
| 5,203,021 | A | 4/1993 | Repplinger et al. |
| 5,210,510 | A | 5/1993 | Karsikas |
| 5,210,542 | A | 5/1993 | Pett et al. |
| 5,220,335 | A | 6/1993 | Huang |
| 5,229,777 | A | 7/1993 | Doyle |
| 5,239,279 | A | 8/1993 | Turunen |
| 5,278,528 | A | 1/1994 | Turunen |
| 5,281,326 | A | 1/1994 | Galla |
| 5,298,873 | A | 3/1994 | Ala-Kojola |
| 5,302,924 | A | 4/1994 | Jantunen |
| 5,304,968 | A | 4/1994 | Ohtonen |
| 5,307,036 | A | 4/1994 | Turunen |
| 5,319,328 | A | 6/1994 | Turunen |
| 5,349,315 | A | 9/1994 | Ala-Kojola |
| 5,349,700 | A | 9/1994 | Parker |
| 5,351,023 | A | 9/1994 | Niiranen |
| 5,354,463 | A | 10/1994 | Turunen |
| 5,355,142 | A | 10/1994 | Marshall et al. |
| 5,357,262 | A | 10/1994 | Blaese |
| 5,363,114 | A | 11/1994 | Shoemaker |
| 5,369,782 | A | 11/1994 | Kawano et al. |
| 5,382,959 | A | 1/1995 | Pett et al. |
| 5,386,214 | A | 1/1995 | Sugawara |
| 5,387,886 | A | 2/1995 | Takalo |
| 5,394,162 | A | 2/1995 | Korovesis et al. |
| RE34,898 | E | 4/1995 | Turunen |
| 5,408,206 | A | 4/1995 | Turunen |
| 5,418,508 | A | 5/1995 | Puurunen |
| 5,432,489 | A | 7/1995 | Yrjola |
| 5,438,697 | A | 8/1995 | Fowler et al. |
| 5,440,315 | A | 8/1995 | Wright et al. |
| 5,442,280 | A | 8/1995 | Baudart |
| 5,442,366 | A | 8/1995 | Sanford |
| 5,444,453 | A | 8/1995 | Lalezari |
| 5,467,065 | A | 11/1995 | Turunen |
| 5,473,295 | A | 12/1995 | Turunen |
| 5,506,554 | A | 4/1996 | Ala-Kojola |
| 5,508,668 | A | 4/1996 | Prokkola |
| 5,510,802 | A | 4/1996 | Tsuru et al. |
| 5,517,683 | A | 5/1996 | Collett et al. |
| 5,521,561 | A | 5/1996 | Yrjola |
| 5,526,003 | A | 6/1996 | Ogawa et al. |
| 5,532,703 | A | 7/1996 | Stephens et al. |
| 5,541,560 | A | 7/1996 | Turunen |
| 5,541,617 | A | 7/1996 | Connolly et al. |
| 5,543,764 | A | 8/1996 | Turunen |
| 5,550,519 | A | 8/1996 | Korpela |
| 5,557,287 | A | 9/1996 | Pottala et al. |
| 5,557,292 | A | 9/1996 | Nygren et al. |
| 5,566,441 | A | 10/1996 | Marsh et al. |
| 5,570,071 | A | 10/1996 | Ervasti |
| 5,585,771 | A | 12/1996 | Ervasti |
| 5,585,810 | A | 12/1996 | Tsuru et al. |
| 5,589,844 | A | 12/1996 | Belcher et al. |
| 5,594,395 | A | 1/1997 | Niiranen |
| 5,604,471 | A | 2/1997 | Rattila |
| 5,627,502 | A | 5/1997 | Ervasti |
| 5,649,316 | A | 7/1997 | Prodhomme et al. |
| 5,668,561 | A | 9/1997 | Perrotta et al. |
| 5,675,301 | A | 10/1997 | Nappa |
| 5,689,221 | A | 11/1997 | Niiranen |
| 5,694,135 | A | 12/1997 | Dikun et al. |
| 5,696,517 | A | 12/1997 | Kawahata et al. |
| 5,703,600 | A | 12/1997 | Burrell et al. |
| 5,709,832 | A | 1/1998 | Hayes et al. |
| 5,711,014 | A | 1/1998 | Crowley et al. |
| 5,717,368 | A | 2/1998 | Niiranen |
| 5,731,749 | A | 3/1998 | Yrjola |
| 5,734,305 | A | 3/1998 | Ervasti |
| 5,734,350 | A | 3/1998 | Deming et al. |
| 5,734,351 | A | 3/1998 | Ojantakanen |
| 5,739,735 | A | 4/1998 | Pyykko |
| 5,742,259 | A | 4/1998 | Annamaa |
| 5,757,327 | A | 5/1998 | Yajima et al. |
| 5,760,746 | A | 6/1998 | Kawahata |
| 5,764,190 | A | 6/1998 | Murch et al. |
| 5,767,809 | A | 6/1998 | Chuang et al. |
| 5,768,217 | A | 6/1998 | Sonoda et al. |
| 5,777,581 | A | 7/1998 | Lilly et al. |
| 5,777,585 | A | 7/1998 | Tsuda et al. |
| 5,793,269 | A | 8/1998 | Ervasti |
| 5,797,084 | A | 8/1998 | Tsuru et al. |
| 5,812,094 | A | 9/1998 | Maldonado |
| 5,815,048 | A | 9/1998 | Ala-Kojola |
| 5,822,705 | A | 10/1998 | Lehtola |
| 5,852,421 | A | 12/1998 | Maldonado |
| 5,861,854 | A | 1/1999 | Kawahata et al. |
| 5,874,926 | A | 2/1999 | Tsuru et al. |

(56) References Cited

U.S. PATENT DOCUMENTS 5,880,697 A 3/1999 McCarrick et al.
5,886,668 A 3/1999 Pedersen et al.
5,892,490 A 4/1999 Kenji Asakura et al.
5,903,820 A 5/1999 Hagstrom
5,905,475 A 5/1999 Annamaa
5,920,290 A 7/1999 McDonough et al.
5,926,139 A 7/1999 Korisch
5,929,813 A 7/1999 Eggleston
5,936,583 A 8/1999 Sekine et al.
5,943,016 A 8/1999 Snyder, Jr. et al.
5,952,975 A 9/1999 Pedersen et al.
5,959,583 A 9/1999 Funk
5,963,180 A 10/1999 Leisten
5,966,097 A 10/1999 Fukasawa et al.
5,970,393 A 10/1999 Khorrami et al.
5,977,710 A 11/1999 Kuramoto et al.
5,986,606 A 11/1999 Kossiavas et al.
5,986,608 A 11/1999 Korisch et al.
5,990,848 A 11/1999 Annamaa
5,999,132 A 12/1999 Kitchener et al.
6,005,529 A 12/1999 Hutchinson
6,006,419 A 12/1999 Vandendolder et al.
6,008,764 A 12/1999 Ollikainen
6,009,311 A 12/1999 Killion et al.
6,014,106 A 1/2000 Annamaa
6,016,130 A 1/2000 Annamaa
6,023,608 A 2/2000 Yrjola
6,031,496 A 2/2000 Kuittinen et al.
6,034,637 A 3/2000 McCoy et al.
6,037,848 A 3/2000 Alila
6,043,780 A 3/2000 Funk et al.
6,052,096 A 4/2000 Tsuru et al.
6,072,434 A 6/2000 Papatheodorou
6,078,231 A 6/2000 Pelkonen
6,091,363 A 7/2000 Komatsu et al.
6,091,365 A 7/2000 Derneryd et al.
6,097,345 A 8/2000 Walton
6,100,849 A 8/2000 Tsubaki et al.
6,112,106 A 8/2000 Crowley et al.
6,121,931 A 9/2000 Levi et al.
6,133,879 A 10/2000 Grangeat et al.
6,134,421 A 10/2000 Lee et al.
6,140,966 A 10/2000 Pankinaho
6,140,973 A 10/2000 Annamaa
6,147,650 A 11/2000 Kawahata Kazunari et al.
6,157,819 A 12/2000 Vuokko
6,177,908 B1 1/2001 Kawahata
6,185,434 B1 2/2001 Hagstrom
6,190,942 B1 2/2001 Wilm et al.
6,195,049 B1 2/2001 Kim et al.
6,204,826 B1 3/2001 Rutkowski et al.
6,215,376 B1 4/2001 Hagstrom
6,218,989 B1 4/2001 Schneider et al.
6,246,368 B1 6/2001 Deming et al.
6,252,552 B1 6/2001 Tarvas et al.
6,252,554 B1 6/2001 Isohatala et al.
6,255,994 B1 7/2001 Saito
6,268,831 B1 7/2001 Sanford
6,281,848 B1 8/2001 Nagumo et al.
6,295,029 B1 9/2001 Chen et al.
6,297,776 B1 10/2001 Pankinaho
6,304,220 B1 10/2001 Herve et al.
6,308,720 B1 10/2001 Modi
6,316,975 B1 11/2001 O'Toole et al.
6,323,811 B1 11/2001 Tsubaki
6,326,921 B1 12/2001 Egorov et al.
6,337,663 B1 1/2002 Chi-Minh
6,340,954 B1 1/2002 Annamaa et al.
6,342,859 B1 1/2002 Kurz et al.
6,343,208 B1 1/2002 Ying
6,346,914 B1 2/2002 Annamaa
6,348,892 B1 2/2002 Annamaa
6,353,443 B1 3/2002 Ying
6,366,243 B1 4/2002 Isohatala
6,377,827 B1 4/2002 Rydbeck
6,380,905 B1 4/2002 Annamaa
6,396,444 B1 5/2002 Goward
6,404,394 B1 6/2002 Hill
6,417,813 B1 7/2002 Durham et al.
6,421,014 B1 7/2002 Sanad
6,423,915 B1 7/2002 Winter
6,429,818 B1 8/2002 Johnson et al.
6,452,551 B1 9/2002 Chen
6,452,558 B1 9/2002 Saitou et al.
6,456,249 B1 9/2002 Johnson et al.
6,459,413 B1 10/2002 Tseng et al.
6,462,716 B1 10/2002 Kushihi
6,469,673 B2 10/2002 Kaiponen
6,473,056 B2 10/2002 Annamaa
6,476,767 B2 11/2002 Aoyama et al.
6,476,769 B1 11/2002 Lehtola
6,480,155 B1 11/2002 Eggleston
6,483,462 B2 11/2002 Weinberger
6,498,586 B2 12/2002 Pankinaho
6,501,425 B1 12/2002 Nagumo
6,515,625 B1 2/2003 Johnson
6,518,925 B1 2/2003 Annamaa
6,529,168 B2 3/2003 Mikkola
6,529,749 B1 3/2003 Hayes et al.
6,535,170 B2 3/2003 Sawamura et al.
6,538,604 B1 3/2003 Isohatala
6,538,607 B2 3/2003 Barna
6,542,050 B1 4/2003 Arai et al.
6,549,167 B1 4/2003 Yoon
6,552,686 B2 4/2003 Ollikainen et al.
6,556,812 B1 4/2003 Pennanen et al.
6,566,944 B1 5/2003 Pehlke
6,580,396 B2 6/2003 Lin
6,580,397 B2 6/2003 Lindell
6,600,449 B2 7/2003 Onaka
6,603,430 B1 8/2003 Hill et al.
6,606,016 B2 8/2003 Takamine et al.
6,611,235 B2 8/2003 Barna et al.
6,614,400 B2 9/2003 Egorov
6,614,401 B2 9/2003 Onaka et al.
6,614,405 B1 9/2003 Mikkoken
6,634,564 B2 10/2003 Kuramochi
6,636,181 B2 10/2003 Asano
6,639,564 B2 10/2003 Johnson
6,646,606 B2 11/2003 Mikkola
6,650,295 B2 11/2003 Ollikainen et al.
6,657,593 B2 12/2003 Nagumo et al.
6,657,595 B1 12/2003 Phillips et al.
6,670,926 B2 12/2003 Miyasaka
6,677,903 B2 1/2004 Wang
6,680,705 B2 1/2004 Tan et al.
6,683,573 B2 1/2004 Park
6,693,594 B2 2/2004 Pankinaho et al.
6,717,551 B1 4/2004 Desclos et al.
6,727,857 B2 4/2004 Mikkola
6,734,825 B1 5/2004 Guo et al.
6,734,826 B1 5/2004 Dai et al.
6,738,022 B2 5/2004 Klaavo et al.
6,741,214 B1 5/2004 Kadambi et al.
6,753,813 B2 6/2004 Kushihi
6,759,989 B2 7/2004 Tarvas et al.
6,765,536 B2 7/2004 Phillips et al.
6,774,853 B2 8/2004 Wong et al.
6,781,545 B2 8/2004 Sung
6,801,166 B2 10/2004 Mikkola
6,801,169 B1 10/2004 Chang et al.
6,806,835 B2 10/2004 Iwai
6,819,287 B2 11/2004 Sullivan et al.
6,819,293 B2 11/2004 De Graauw
6,825,818 B2 11/2004 Toncich
6,836,249 B2 12/2004 Kenoun et al.
6,847,329 B2 1/2005 Ikegaya et al.
6,856,293 B2 2/2005 Bordi
6,862,437 B1 3/2005 McNamara
6,862,441 B2 3/2005 Ella
6,873,291 B2 3/2005 Aoyama
6,876,329 B2 4/2005 Milosavljevic
6,882,317 B2 4/2005 Koskiniemi
6,891,507 B2 5/2005 Kushihi et al.

(56) References Cited

U.S. PATENT DOCUMENTS 6,897,810 B2 5/2005 Dai et al.
6,900,768 B2 5/2005 Iguchi et al.
6,903,692 B2 6/2005 Kivekas
6,911,945 B2 6/2005 Korva
6,922,171 B2 7/2005 Annamaa
6,925,689 B2 8/2005 Folkmar
6,927,729 B2 8/2005 Legay
6,933,891 B2 8/2005 Lange
6,937,196 B2 8/2005 Korva
6,950,065 B2 9/2005 Ying et al.
6,950,066 B2 9/2005 Hendler et al.
6,950,068 B2 9/2005 Bordi
6,950,072 B2 9/2005 Miyata et al.
6,952,144 B2 10/2005 Javor
6,952,187 B2 10/2005 Annamaa
6,958,730 B2 10/2005 Nagumo et al.
6,961,544 B1 11/2005 Hagstrom
6,963,308 B2 11/2005 Korva
6,963,310 B2 11/2005 Horita et al.
6,967,618 B2 11/2005 Ojantakanen
6,975,278 B2 12/2005 Song et al.
6,980,158 B2 12/2005 Iguchi et al.
6,985,108 B2 1/2006 Mikkola
6,992,543 B2 1/2006 Luetzelschwab et al.
6,995,710 B2 2/2006 Sugimoto et al.
7,023,341 B2 4/2006 Stilp
7,031,744 B2 4/2006 Kuriyama et al.
7,034,752 B2 4/2006 Sekiguchi et al.
7,042,403 B2 5/2006 Colburn et al.
7,053,841 B2 5/2006 Ponce De Leon et al.
7,054,671 B2 5/2006 Kaiponen et al.
7,057,560 B2 6/2006 Erkocevic
7,061,430 B2 6/2006 Zheng et al.
7,064,719 B2 * 6/2006 Wu ..... H01Q 1/243 343/702
7,081,857 B2 7/2006 Kinnunen et al.
7,084,831 B2 8/2006 Takagi et al.
7,099,690 B2 8/2006 Milosavljevic
7,113,133 B2 9/2006 Chen et al.
7,119,749 B2 10/2006 Miyata et al.
7,126,546 B2 10/2006 Annamaa
7,129,893 B2 10/2006 Otaka et al.
7,136,019 B2 11/2006 Mikkola
7,136,020 B2 11/2006 Yamaki
7,142,824 B2 11/2006 Kojima et al.
7,148,847 B2 12/2006 Yuanzhu
7,148,849 B2 12/2006 Lin
7,148,851 B2 12/2006 Takaki et al.
7,170,464 B2 1/2007 Tang et al.
7,176,838 B1 2/2007 Kinezos
7,180,455 B2 2/2007 Oh et al.
7,193,574 B2 3/2007 Chiang et al.
7,205,942 B2 4/2007 Wang et al.
7,215,283 B2 5/2007 Boyle
7,218,280 B2 5/2007 Annamaa
7,218,282 B2 5/2007 Humpfer et al.
7,224,313 B2 5/2007 McKinzie, III et al.
7,230,574 B2 6/2007 Johnson
7,233,775 B2 6/2007 De Graauw
7,237,318 B2 7/2007 Annamaa
7,256,743 B2 8/2007 Korva
7,274,334 B2 9/2007 O'Riordan et al.
7,283,097 B2 10/2007 Wen et al.
7,289,064 B2 10/2007 Cheng
7,292,200 B2 11/2007 Posluszny et al.
7,319,432 B2 1/2008 Andersson
7,330,153 B2 2/2008 Rentz
7,333,067 B2 2/2008 Hung et al.
7,339,528 B2 3/2008 Wang et al.
7,340,286 B2 3/2008 Korva et al.
7,345,634 B2 3/2008 Ozkar et al.
7,352,326 B2 4/2008 Korva
7,355,270 B2 4/2008 Hasebe et al.
7,358,902 B2 4/2008 Erkocevic
7,375,695 B2 5/2008 Ishizuka et al.
7,381,774 B2 6/2008 Bish et al.
7,382,319 B2 6/2008 Kawahata et al.
7,385,556 B2 6/2008 Chung et al.
7,388,543 B2 6/2008 Vance
7,391,378 B2 6/2008 Mikkola
7,405,702 B2 7/2008 Annamaa et al.
7,417,588 B2 8/2008 Castany et al.
7,423,592 B2 9/2008 Pros et al.
7,432,860 B2 10/2008 Huynh
7,439,929 B2 10/2008 Ozkar
7,443,344 B2 10/2008 Boyle
7,468,700 B2 12/2008 Milosavljevic
7,468,709 B2 12/2008 Niemi
7,498,990 B2 3/2009 Park et al.
7,501,983 B2 3/2009 Mikkola
7,502,598 B2 3/2009 Kronberger
7,564,413 B2 7/2009 Kim et al.
7,589,678 B2 9/2009 Perunka et al.
7,616,158 B2 11/2009 Mark et al.
7,633,449 B2 12/2009 Oh
7,663,551 B2 2/2010 Nissinen
7,679,565 B2 3/2010 Sorvala
7,692,543 B2 4/2010 Copeland
7,710,325 B2 5/2010 Cheng
7,724,204 B2 5/2010 Annamaa
7,760,146 B2 7/2010 Ollikainen
7,764,245 B2 7/2010 Loyet
7,786,938 B2 8/2010 Sorvala
7,800,544 B2 9/2010 Thornell-Pers
7,830,327 B2 11/2010 He
7,843,397 B2 11/2010 Boyle
7,889,139 B2 2/2011 Hobson et al.
7,889,143 B2 2/2011 Milosavljevic
7,901,617 B2 3/2011 Taylor
7,903,035 B2 3/2011 Mikkola et al.
7,916,086 B2 3/2011 Koskiniemi et al.
7,963,347 B2 6/2011 Pabon
7,973,720 B2 7/2011 Sorvala
8,049,670 B2 11/2011 Jung et al.
8,054,232 B2 11/2011 Chiang et al.
8,098,202 B2 1/2012 Annamaa et al.
8,179,322 B2 5/2012 Nissinen
8,193,998 B2 6/2012 Puente et al.
8,378,892 B2 2/2013 Sorvala
8,466,756 B2 6/2013 Milosavljevic et al.
8,473,017 B2 6/2013 Milosavljevic et al.
8,564,485 B2 10/2013 Milosavljevic et al.
8,629,813 B2 1/2014 Milosavljevic
2001/0050636 A1 12/2001 Weinberger
2002/0000940 A1 * 1/2002 Moren ..... H01Q 1/243 343/702
2002/0183013 A1 12/2002 Auckland et al.
2002/0196192 A1 12/2002 Nagumo et al.
2003/0146873 A1 8/2003 Blancho
2004/0090378 A1 5/2004 Dai et al.
2004/0137950 A1 7/2004 Bolin et al.
2004/0145525 A1 7/2004 Annabi et al.
2004/0171403 A1 9/2004 Mikkola
2005/0057401 A1 3/2005 Yuanzhu
2005/0159131 A1 7/2005 Shibagaki et al.
2005/0176481 A1 8/2005 Jeong
2006/0071857 A1 4/2006 Pelzer
2006/0192723 A1 8/2006 Harada
2007/0042615 A1 2/2007 Liao
2007/0082789 A1 4/2007 Nissila
2007/0152881 A1 7/2007 Chan
2007/0188388 A1 8/2007 Feng
2008/0055164 A1 3/2008 Zhang et al.
2008/0059106 A1 3/2008 Wight
2008/0088511 A1 4/2008 Sorvala
2008/0266199 A1 10/2008 Milosavljevic
2009/0009415 A1 1/2009 Tanska
2009/0135066 A1 5/2009 Raappana et al.
2009/0153412 A1 6/2009 Chiang et al.
2009/0174604 A1 7/2009 Keskitalo
2009/0196160 A1 8/2009 Crombach
2009/0197654 A1 8/2009 Teshima
2009/0231213 A1 9/2009 Ishimiya
2010/0220016 A1 9/2010 Nissinen

(56) References Cited

U.S. PATENT DOCUMENTS

| | | | |
|---|---|---|---|
| 2010/0244978 | A1 | 9/2010 | Milosavljevic |
| 2010/0309092 | A1 | 12/2010 | Lambacka |
| 2011/0133994 | A1 | 6/2011 | Korva |
| 2011/0237309 | A1 | 9/2011 | Shoji et al. |
| 2012/0119955 | A1 | 5/2012 | Milosavljevic et al. |
| 2013/0229314 | A1 | 9/2013 | Kuehler et al. |
| 2013/0265199 | A1 | 10/2013 | Koskiniemi et al. |

FOREIGN PATENT DOCUMENTS

| | | |
|---|---|---|
| DE | 10150149 | 4/2003 |
| EP | 0 208 424 | 1/1987 |
| EP | 0 376 643 | 4/1990 |
| EP | 0 751 043 | 4/1997 |
| EP | 0 807 988 | 11/1997 |
| EP | 0 831 547 | 3/1998 |
| EP | 0 851 530 | 7/1998 |
| EP | 1 294 048 | 1/1999 |
| EP | 1 014 487 | 6/2000 |
| EP | 1 024 553 | 8/2000 |
| EP | 1 067 627 | 1/2001 |
| EP | 0 923 158 | 9/2002 |
| EP | 1 329 980 | 7/2003 |
| EP | 1 361 623 | 11/2003 |
| EP | 1 406 345 | 4/2004 |
| EP | 1 453 137 | 9/2004 |
| EP | 1 220 456 | 10/2004 |
| EP | 1 467 456 | 10/2004 |
| EP | 1 753 079 | 2/2007 |
| FI | 20020829 | 11/2003 |
| FI | 118782 | 3/2008 |
| FR | 2553584 | 10/1983 |
| FR | 2724274 | 3/1996 |
| FR | 2873247 | 1/2006 |
| GB | 2266997 | 11/1993 |
| GB | 2360422 | 9/2001 |
| GB | 2389246 | 12/2003 |
| JP | 59-202831 | 11/1984 |
| JP | 60-206304 | 10/1985 |
| JP | 61-245704 | 11/1986 |
| JP | 06-152463 | 5/1994 |
| JP | 07-131234 | 5/1995 |
| JP | 07-221536 | 8/1995 |
| JP | 07-249923 | 9/1995 |
| JP | 07-307612 | 11/1995 |
| JP | 08-216571 | 8/1996 |
| JP | 09-083242 | 3/1997 |
| JP | 09-260934 | 10/1997 |
| JP | 09-307344 | 11/1997 |
| JP | 10-028013 | 1/1998 |
| JP | 10-107671 | 4/1998 |
| JP | 10-173423 | 6/1998 |
| JP | 10-209733 | 8/1998 |
| JP | 10-224142 | 8/1998 |
| JP | 10-322124 | 12/1998 |
| JP | 10-327011 | 12/1998 |
| JP | 11-004113 | 1/1999 |
| JP | 11-004117 | 1/1999 |
| JP | 11-068456 | 3/1999 |
| JP | 11-127010 | 5/1999 |
| JP | 11-127014 | 5/1999 |
| JP | 11-136025 | 5/1999 |
| JP | 11-355033 | 12/1999 |
| JP | 2000-278028 | 10/2000 |
| JP | 2001-053543 | 2/2001 |
| JP | 2001-267833 | 9/2001 |
| JP | 2001-217631 | 10/2001 |
| JP | 2001-326513 | 11/2001 |
| JP | 2002-319811 | 10/2002 |
| JP | 2002-329541 | 11/2002 |
| JP | 2002-335117 | 11/2002 |
| JP | 2003-060417 | 2/2003 |
| JP | 2003-124730 | 4/2003 |
| JP | 2003-179426 | 6/2003 |
| JP | 2004-112028 | 4/2004 |
| JP | 2004-363859 | 12/2004 |
| JP | 2005-005985 | 1/2005 |
| JP | 2005-252661 | 9/2005 |
| KR | 20010080521 | 10/2001 |
| KR | 20020096016 | 12/2002 |
| SE | 511900 | 12/1999 |
| WO | WO 92/00635 | 1/1992 |
| WO | WO 96/27219 | 9/1996 |
| WO | WO 98/01919 | 1/1998 |
| WO | WO 99/30479 | 6/1999 |
| WO | WO 01/20718 | 3/2001 |
| WO | WO 01/29927 | 4/2001 |
| WO | WO 01/33665 | 5/2001 |
| WO | WO 01/61781 | 8/2001 |
| WO | WO 2004/017462 | 2/2004 |
| WO | WO 2004/057697 | 7/2004 |
| WO | WO 2004/100313 | 11/2004 |
| WO | WO 2004/112189 | 12/2004 |
| WO | WO 2005/062416 | 7/2005 |
| WO | WO 2007/012697 | 2/2007 |
| WO | WO 2010/122220 | 10/2010 |

OTHER PUBLICATIONS

"Dual Band Antenna for Hand Held Portable Telephones", Liu et al., Electronics Letters, vol. 32, No. 7, 1996, pp. 609-610.

"Improved Bandwidth of Microstrip Antennas using Parasitic Elements," IEE Proc. vol. 127, Pt. H. No. 4, Aug. 1980.

"A 13.56MHz RFID Device and Software for Mobile Systems", by H. Ryoson, et al., Micro Systems Network Co., 2004 IEEE, pp. 241-244.

"A Novel Approach of a Planar Multi-Band Hybrid Series Feed Network for Use in Antenna Systems Operating at Millimeter Wave Frequencies," by M.W. Elsallal and B.L. Hauck, Rockwell Collins, Inc., 2003 pp. 15-24, waelsall@rockwellcollins.com and blhauck@rockwellcollins.com.

Abedin, M. F. and M. Ali, "Modifying the ground plane and its erect on planar inverted-F antennas (PIFAs) for mobile handsets," *IEEE Antennas and Wireless Propagation Letters*, vol. 2, 226-229, 2003.

C. R. Rowell and R. D. Murch, "A compact PIFA suitable for dual frequency 900/1800-MHz operation," *IEEE Trans. Antennas Propag.*, vol. 46, No. 4, pp. 596-598, Apr. 1998.

Cheng-Nan Hu, Willey Chen, and Book Tai, "A Compact Multi-Band Antenna Design for Mobile Handsets", *APMC 2005 Proceedings*.

Endo, T., Y. Sunahara, S. Satoh and T. Katagi, "Resonant Frequency and Radiation Efficiency of Meander Line Antennas," Electronics and Commu-nications in Japan, Part 2, vol. 83, No. 1, 52-58, 2000.

European Office Action, May 30, 2005 issued during prosecution of EP 04 396 001.2-1248.

Examination Report dated May 3, 2006 issued by the EPO for European Patent Application No. 04 396 079.8.

F.R. Hsiao, et al. "A dual-band planar inverted-F patch antenna with a branch-line slit," *Microwave Opt. Technol. Lett.*, vol. 32, Feb. 20, 2002.

Griffin, Donald W. et al., "Electromagnetic Design Aspects of Packages for Monolithic Microwave Integrated Circuit-Based Arrays with Integrated Antenna Elements", IEEE Transactions on Antennas and Propagation, vol. 43, No. 9, pp. 927-931, Sep. 1995.

Guo, Y. X. and H. S. Tan, "New compact six-band internal antenna," *IEEE Antennas and Wireless Propagation Letters*, vol. 3, 295-297, 2004.

Guo, Y. X. and Y.W. Chia and Z. N. Chen, "Miniature built-in quadband antennas for mobile handsets", *IEEE Antennas Wireless Propag. Left.*, vol. 2, pp. 30-32, 2004.

Hoon Park, et al. "Design of an Internal antenna with wide and multiband characteristics for a mobile handset", *IEEE Microw. & Opt. Tech. Lett.* vol. 48, No. 5, May 2006.

Hoon Park, et al. "Design of Planar Inverted-F Antenna With Very Wide Impedance Bandwidth", *IEEE Microw. & Wireless Comp., Lett.*, vol. 16, No. 3, pp. 113-115-, Mar. 2006.

Hossa, R., A. Byndas, and M. E. Bialkowski, "Improvement of compact terminal antenna performance by incorporating open-end slots in ground plane," *IEEE Microwave and Wireless Components Letters*, vol. 14, 283-285, 2004.

(56) References Cited

OTHER PUBLICATIONS

I. Ang, Y. X. Guo, and Y. W. Chia, "Compact internal quad-band antenna for mobile phones" *Micro. Opt. Technol. Lett.*, vol. 38, No. 3, pp. 217-223 Aug. 2003.
International Preliminary Report on Patentability for International Application No. PCT/FI2004/000554, date of issuance of report May 1, 2006.
Jing, X., et al.; "Compact Planar Monopole Antenna for Multi-Band Mobile Phones"; Microwave Conference Proceedings, 4.-7.12. 2005.APMC 2005, Asia-Pacific Conference Proceedings, vol. 4.
Kim, B. C., J. H. Yun, and H. D. Choi, "Small wideband PIFA for mobile phones at 1800 MHz," *IEEE International Conference on Vehicular Technology*, 27{29, Daejeon, South Korea, May 2004.
Kim, Kihong et al., "Integrated Dipole Antennas on Silicon Substrates for Intra-Chip Communication", IEEE, pp. 1582-1585, 1999.
Kivekas., O., J. Ollikainen, T. Lehtiniemi, and P. Vainikainen, "Bandwidth, SAR, and eciency of internal mobile phone antennas," *IEEE Transactions on Electromagnetic Compatibility*, vol. 46, 71{86, 2004.
K-L Wong, *Planar Antennas for Wireless Communications*, Hoboken, NJ: Willey, 2003, ch. 2.
Lindberg., P. and E. Ojefors, "A bandwidth enhancement technique for mobile handset antennas using wavetraps," *IEEE Transactions on Antennas and Propagation*, vol. 54, 2226{2232, 2006.
Marta Martinez-Vazquez, et al., "Integrated Planar Multiband Antennas for Personal Communication Handsets", *IEEE Trasactions on Antennas and propagation*, vol. 54, No. 2, Feb. 2006.
P. Ciais, et al., "Compact Internal Multiband Antennas for Mobile and WLAN Standards", *Electronic Letters*, vol. 40, No. 15, pp. 920-921, Jul. 2004.
P. Ciais, R. Staraj, G. Kossiavas, and C. Luxey, "Design of an internal quadband antenna for mobile phones", *IEEE Microwave Wireless Comp. Lett.*, vol, 14, No. 4, pp. 148-150, Apr. 2004.
P. Salonen, et al. "New slot configurations for dual-band planar inverted-F antenna," *Microwave Opt. Technol.*, vol. 28, pp. 293-298, 2001.
Papapolymerou, Ioannis et al., "Micromachined Patch Antennas", IEEE Transactions on Antennas and Propagation, vol. 46, No. 2, pp. 275-283, Feb. 1998.
Product of the Month, RFDesign, "GSM/GPRS Quad Band Power Amp Includes Antenna Switch," 1 page, reprinted Nov. 2004 issue of RF Design (www.rfdesign.com), Copyright 2004, Freescale Semiconductor, RED-24-EK.
S. Tarvas, et al. "An internal dual-band mobile phone antenna," in *2000 IEEE Antennas Propagat. Soc. Int. Symp. Dig.*, pp. 266-269, Salt Lake City, UT, USA.
Wang, F., Z. Du, Q. Wang, and K. Gong, "Enhanced-bandwidth PIFA with T-shaped ground plane," *Electronics Letters*, vol. 40, 1504-1505, 2004.
Wang, H.; "Dual-Resonance Monopole Antenna with Tuning Stubs"; IEEE Proceedings, Microwaves, Antennas & Propagation, vol. 153, No. 4, Aug. 2006; pp. 395-399.
Wong, K., et al.; "A Low-Profile Planar Monopole Antenna for Multiband Operation of Mobile Handsets"; IEEE Transactions on Antennas and Propagation, Jan. '03, vol. 51, No. 1.
X.-D. Cai and J.-Y. Li, Analysis of asymmetric TEM cell and its optimum design of electric field distribution, IEE Proc 136 (1989), 191-194.
X.-Q. Yang and K.-M. Huang, Study on the key problems of interaction between microwave and chemical reaction, Chin Jof Radio Sci 21 (2006), 802-809.
Chiu, C.-W., et al., "A Meandered Loop Antenna for LTE/WWAN Operations in a Smartphone," Progress in Electromagnetics Research C, vol. 16, pp. 147-160, 2010.
Lin, Sheng-Yu; Liu, Hsien-Wen; Weng, Chung-Hsun; and Yang, Chang-Fa, "A miniature Coupled loop Antenna to be Embedded in a Mobile Phone for Penta-band Applications," Progress in Electromagnetics Research Symposium Proceedings, Xi'An, China, Mar. 22-26, 2010, pp. 721-724.
Zhang, Y.Q., et al. "Band-Notched UWB Crossed Semi-Ring Monopole Antenna," Progress in Electronics Research C, vol. 19, 107-118, 2011, pp. 107-118.
Joshi, Ravi K., et al., "Broadband Concentric Rings Fractal Slot Antenna", XXVIIIth General Assembly of International Union of Radio Science (URSI). (Oct. 23-29, 2005), 4 Pgs.
Singh, Rajender, "Broadband Planar Monopole Antennas," M.Tech credit seminar report, Electronic Systems group, EE Dept, IIT Bombay, Nov. 2003, pp. 1-24.
Gobien, Andrew, T. "*Investigation of Low Profile Antenna Designs for Use in Hand-Held Radios*," Ch.3, *The Inverted-L Antenna and Variations*; Aug. 1997, pp. 42-76.
See, C.H., et al., "Design of Planar Metal-Plate Monopole Antenna for Third Generation Mobile Handsets," Telecommunications Research Centre, Bradford University, 2005. pp. 27-30.
"LTE—an introduction," Ericsson White Paper, Jun. 2009, pp. 1-16.
"Spectrum Analysis for Future LTE Deployments," Motorola White Paper, 2007, pp. 1-8.
Chi, Yun-Wen, et al. "Quarter-Wavelength Printed Loop Antenna With an Internal Printed Matching Circuit for GSM/DCS/PCS/UMTS Operation in the Mobile Phone," IEEE Transactions on Antennas and Propagation, vol. 57, No. 9m Sep. 2009, pp. 2541-2547.
Wong, Kin-Lu, et al. "Planar Antennas for WLAN Applications," Dept. of Electrical Engineering, National Sun Yat-Sen University, 2002 09 Ansoft Workshop, pp. 1-45.
"λ/4 printed monopole antenna for 2.45GHz," Nordic Semiconductor, White Paper, 2005, pp. 1-6.
White, Carson, R., "Single- and Dual-Polarized Slot and Patch Antennas with Wide Tuning Ranges," The University of Michigan, 2008.
Extended European Search Report dated Jan. 30, 2013, issued by the EPO for EP Patent Application No. 12177740.3.
Chen, Jin-Sen, et al., "CPW-fed Ring Slot of Antenna with Small Ground Plane," Department of Electronic Engineering, Cheng Shiu University, 3 pgs.

* cited by examiner

REDUCED SURFACE AREA ANTENNA APPARATUS AND MOBILE COMMUNICATIONS DEVICES INCORPORATING THE SAME

PRIORITY

This application claims the benefit of priority to co-owned U.S. Provisional Patent Application Ser. No. 61/911,418 entitled "Reduced Surface Area Deposition Antenna Apparatus and Methods", filed Dec. 3, 2013, the contents of which are incorporated herein by reference in its entirety.

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

BACKGROUND

1. Technology Field

The present disclosure relates generally to antenna apparatus for use in electronic devices such as wireless or portable radio devices, and more particularly in one exemplary aspect to antennas manufactured using the deposition of conductive materials, and methods of making and utilizing the same.

2. Description of Related Technology

Antennas are commonly found in most modem radio devices, such as desktop and mobile computers, mobile phones, tablet computers, smartphones, personal digital assistants (PDAs), or other personal communication devices (PCD). Typically, these antennas comprise a planar metal radiator. The structure is configured so that it functions as a resonator at the desired operating frequency or frequencies. Typically, these antennas are located internal to the device (such as within the outer plastic housing), whether free-standing, disposed on a printed circuit board (PCB) of the radio device, or on another device component, so as to permit propagation of radio frequency waves to and from the antenna(s).

Recent advances in antenna manufacturing processes have enabled the construction of antennas directly onto the surface of a specialized material (e.g., thermoplastic material that is doped with a metal additive). The doped metal additive is activated by means of a laser in a process known as laser direct structuring (LDS), direct metal deposition (DMD), laser metal deposition (LMD) which enables the construction of antennas onto more complex 3-dimensional geometries. In various typical smartphone and other applications, the underlying smartphone housing, and/or other components which the antenna may be disposed on inside the device, may be manufactured using this specialized material, such as for example using standard injection molding processes. A laser is then used to activate areas of the (thermoplastic) material that are to be subsequently plated. Typically, an electrolytic copper bath followed by successive additive layers such as nickel or gold are then added to complete the construction of the antenna.

However, the foregoing manufacturing processes are comparatively costly, especially when considered on a per-area basis. Stated differently, reduction of the area of the (plated) antenna can significantly reduce the cost of manufacturing thereof, as well as requiring the use of less energy, process chemicals, etc. It can also afford a greater degree of design flexibility, in that various portions of the radiator element(s), feeds, etc. can be placed at different locations.

Accordingly, there is a salient need for a wireless antenna solution for e.g., a portable radio device that offers comparable electrical performance to prior art approaches while being manufactured at lower cost and using more flexible, manufacturing processes.

SUMMARY

The present disclosure satisfies the foregoing needs by providing, inter alia, an improved antenna and flexible, low-cost methods of making and using the same.

In a first aspect of the disclosure, an antenna apparatus is disclosed. In one embodiment, the apparatus is for use in a portable communications device, and includes a conductor deposited on a component of the portable device (e.g., interior housing surface).

In another embodiment, the antenna includes a first radiating element having a first and a second branches thereof, and a connecting point; and a plurality of connecting elements disposed substantially between the first and the second branches.

In one variant, at least one of a size and/or a placement of the first and the second branches is configured based on a distance from the connecting point.

In another variant, at least one of a size and/or a placement of at least one of the connecting elements is configured based on a distance from the connecting point.

In a second aspect of the disclosure, a method of manufacturing a "cross-hatch" antenna apparatus is disclosed. In one embodiment, the method comprises depositing (whether by "ink jetting" or spraying or other means of deposition) a conductive fluid in a desired form, and then curing the deposited fluid using e.g., electromagnetic thermal energy flash, application of heat using other means, or other approach.

In another embodiment, the antenna is formed using a laser direct structuring (LDS) process. The antenna radiator may comprise metal-free areas configured to reduce, inter alia, antenna fabrication time.

In a third aspect of the disclosure, a portable radio device is disclosed. In one embodiment, the radio device is a cellular-enabled smartphone with a cross-hatch cellular band antenna. In another embodiment, the smartphone includes a Wi-Fi interface with a cross-hatch antenna. In yet another embodiment, the smartphone includes a GPS receiver with cross-hatch antenna.

In a fourth aspect of the disclosure, a method of manufacturing a portable radio device is disclosed. In one embodiment, the method includes depositing one or more antennas on a component (e.g., housing) of the device in a substantially three-dimensional configuration, the configuration being particularly adapted to the specific geometry and space requirements of that device.

In a fifth aspect of the disclosure, a method of operating an antenna apparatus is disclosed. In one embodiment, the method comprises coupling the antenna apparatus to a radio frequency transceiver, and exciting the apparatus using the transceiver In a sixth aspect of the disclosure, a method of developing an antenna apparatus is disclosed. In one embodiment, the method comprises depositing a cross-hatch antenna (e.g., a wire-like loop) of a first configuration on a substrate; and subsequently depositing modified configurations of the wire loop antenna on other substrates, and testing the first (e.g., wire loop) antenna and the other configurations to identify more desirable operational features relating to the various configurations.

In a seventh aspect of the disclosure, a method of tuning an antenna apparatus is disclosed.

In an eighth aspect of the disclosure, a method of operating a mobile device is disclosed.

In a ninth aspect of the disclosure, a method of optimizing the performance of a cross-hatch type antenna element is disclosed. In one embodiment, the method includes selectively positioning one or more crossbar elements within the antenna element such as to optimize one or more performance attributes of the antenna, while also minimizing the amount of surface area covered by the radiating portion of the element.

Further features of the present disclosure, its nature and various advantages will be more apparent from the accompanying drawings and the following detailed description.

Figure 1A:
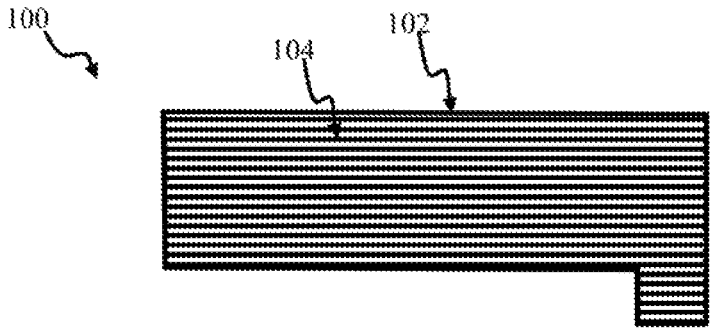
FIG. 1A (Prior Art)
FIG. 1A is a top plan view of a planar antenna element of the prior art illustrating a raster pattern for use with direct metal deposition manufacturing methodology.

All of the above listed Figures are ©Copyright 2013 Pulse Finland Oy. All rights reserved.

DETAILED DESCRIPTION

Reference is now made to the drawings wherein like numerals refer to like parts throughout.

As used herein, the terms "antenna," "antenna system," "antenna assembly", and "multi-band antenna" refer without limitation to any system that incorporates a single element, multiple elements, or one or more arrays of elements that receive/transmit and/or propagate one or more frequency bands of electromagnetic radiation. The radiation may be of numerous types, e.g., microwave, millimeter wave, radio frequency, digital modulated, analog, analog/digital encoded, digitally encoded millimeter wave energy, or the like. The energy may be transmitted from location to another location, using, or more repeater links, and one or more locations may be mobile, stationary, or fixed to a location on earth such as a base station.

As used herein, the terms "board" and "substrate" refer generally and without limitation to any substantially planar or curved surface or component upon which other components can be disposed. For example, a substrate may comprise a single or multi-layered printed circuit board (e.g., FR4), a semi-conductive die or wafer, or even a surface of a housing or other device component, and may be substantially rigid or alternatively at least somewhat flexible.

As used herein, the terms "cure" and "curing" refer without limitation to a process whereby a flowable material is exposed to an agent (whether electromagnetic energy such as infrared, laser, or microwave), heat, or a chemical substance which causes a desirable mechanical or other property to occur within the flowable material. Typically, curing improves or imparts one or more desired properties, such as e.g., the electrical conductivity of the material and adhesion to the substrate.

As used herein, the term "deposition" refers without limitation to any type of process which deposits one material on another, including for example printing (e.g., of a flowable material, defined infra), jetting, plating, and vapor deposition.

As used herein, the term "flowable" refers without limitation to liquids, gels, pastes, ink formulations, solutions, colloidal suspensions, or other physical forms of substances which have the ability to flow in some manner, whether under force of gravity or other applied force.

The terms "frequency range", "frequency band", and "frequency domain" refer without limitation to any frequency range for communicating signals. Such signals may be communicated pursuant to one or more standards or wireless air interfaces.

As used herein, the terms "mobile device", "portable device", "consumer device" or "radio device" may include, but are not limited to, cellular telephones, smartphones, personal computers (PCs) and minicomputers, whether desktop, laptop, or otherwise, as well as mobile devices such as handheld computers, PDAs, personal media devices (PMDs), personal communication devices (PCDs) and/or any combinations of the foregoing, which utilize one or more antennas for emitting or receiving electromagnetic energy such as radio frequency energy.

Furthermore, as used herein, the terms "radiator," "radiating plane," and "radiating element" refer without limitation to an element that can function as part of a system that receives and/or transmits radio-frequency electromagnetic radiation; e.g., an antenna.

The terms "RF feed," "feed," "feed conductor," and "feed network" refer without limitation to any energy conductor and coupling element(s) that can transfer energy, transform impedance, enhance performance characteristics, and conform impedance properties between an incoming/outgoing RF energy signals to that of one or more connective elements, such as for example a radiator.

As used herein, the terms "top", "bottom". "side". "up", "down", "left", "right", and the like merely connote a relative position or geometry of one component to another, and in no way connote an absolute frame of reference or any required orientation. For example, a "top" portion of a component may actually reside below a "bottom" portion when the component is mounted to another device (e.g., to the underside of a PCB).

As used herein, the term "wireless" means any wireless signal, data, communication, or other interface including without limitation Wi-Fi, Bluetooth, 3G (e.g., 3GPP, 3GPP2, and UMTS), HSDPA/HSUPA, TDMA, CDMA (e.g., IS-95A, WCDMA, etc.), FHSS, DSSS, GSM, PAN/802.15, WiMAX (802.16), 802.20, narrowband/FDMA, OFDM, PCS/DCS, Long Term Evolution (LTE) or LTE-Advanced (LTE-A), analog cellular, CDPD, satellite systems such as GPS, millimeter wave or microwave systems, optical, acoustic, and infrared (i.e., IrDA).

Overview

The present disclosure provides, inter alia, improved time- and cost-efficient antenna apparatus and methods for making the same. An internal antenna component may be embodied for example in a mobile wireless device. The antenna in one embodiment includes one or more planar radiator elements fabricated from an electrically conductive material disposed on an internal component (e.g., chassis and/or housing) of the wireless device. The surface area of the antenna radiator metallized portion may be reduced by utilizing a pattern, such as e.g., a crosshatch pattern. The pattern includes one or more metal-free portions disposed within the outline of the radiator. The metal portion of the antenna radiator may be interconnected by conductive crosslinks or members. The antenna is coupled to radio electronics at one or more connection points.

In one variant, at least one of the size and/or a placement of the crosslinks is selectively chosen to obtain the desired performance, such as where the crosslinks are configured based on distance from the connecting points. Crosslink size and/or placement is configured to provide a prescribed current flow (and hence performance) within the antenna.

The internal antenna may be manufactured using a variety of metal deposition technologies, including but not limited to, for example, laser direct structuring (LDS), direct metal deposition (DMD), laser metal deposition (LMD), Direct metal laser sintering (DMLS), printing deposition (e.g., as described in U.S. patent application Ser. No. 13/782,993 entitled "DEPOSITION ANTENNA APPARATUS AND METHODS" filed Mar. 1, 2013, the contents of which are incorporated herein by reference in its entirety), vapor deposition (e.g., CVD), and/or other manufacturing technologies.

The exemplary embodiments of the antenna structure described herein advantageously enable a reduction of antenna manufacturing time and/or cost compared with prior art antenna design approaches. One or more additive manufacturing technologies may utilize a laser in order to convert metal-containing material (e.g., copper-containing powder). In accordance with the principles of the present disclosure, eliminating portions of the antenna metal surface can appreciably reduce time and materials required to build the antenna, in some implementations by reducing plating costs by up to 30% and lasering costs by up to 20%.

The foregoing antenna design methodology may be utilized with a variety of antenna types including for example, inverted F antenna, inverted L, and practically any planar or partly planar antenna structure that may be fabricated using an additive manufacturing technology.

Detailed Description of Exemplary Embodiments

Detailed descriptions of the various embodiments and variants of the apparatus and methods of the disclosure are now provided. While primarily discussed in the context of wireless mobile devices, the various apparatus and methodologies discussed herein are not so limited. In fact, many of the apparatus and methodologies described herein are useful in any number of complex antennas, whether associated with mobile or fixed devices, that can benefit from the antenna methodologies and apparatus described herein.

Exemplary Antenna Apparatus

Figure 1B:
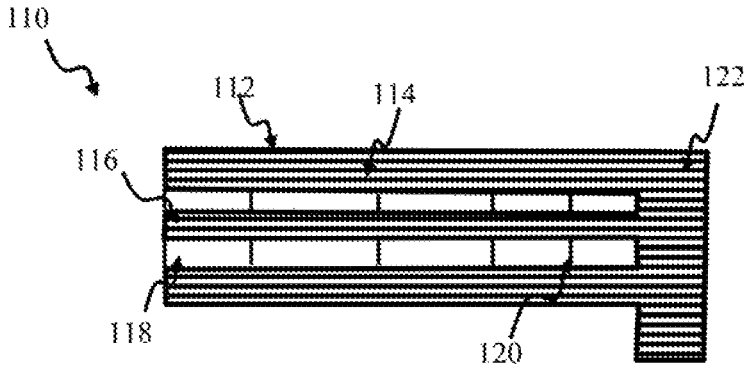
FIG. 1B is a top plan view of a reduced metal surface area planar antenna element in accordance with one implementation of the present disclosure.
Figure 2:
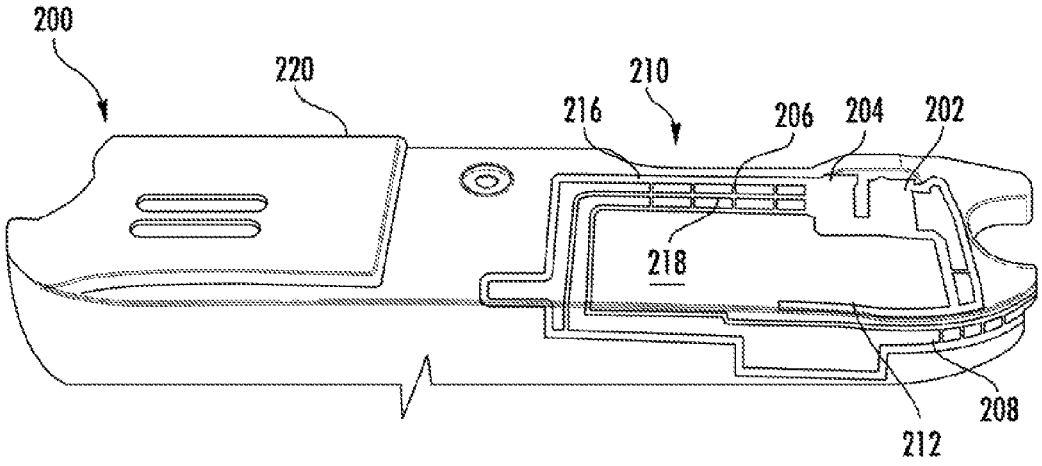
FIG. 2 is a perspective view of a reduced-area antenna structure disposed on a three-dimensional substrate, in accordance with one implementation.

Referring now to FIGS. 1A-2, exemplary embodiments of the antenna apparatus of the disclosure are described in detail.

FIG. 1A illustrates a raster pattern for use with direct metal deposition manufacturing of a planar antenna element of the prior art. The illustrated antenna element 100 is characterized by an outline 102 (shown by a bold line in FIG. 1A). The element 100 may be fabricated using a variety of metal deposition technologies, including but not limited to, for example, laser direct structuring (LDS), direct metal deposition (DMD), laser metal deposition (LMD), direct metal laser sintering (DMLS), flowable conductive deposition, vapor deposition, and/or other manufacturing technologies. During fabrication using, e.g., LDS or DLMS, a laser beam may be moved in a raster pattern within the antenna outline 102. The pattern (shown by lines 104 in FIG. 1A) may comprise any number of individual passes (e.g., 10 to 100 passes). Laser beam footprint width may be selected as desired, such as e.g., between 0.1 mm and 2 mm. In one implementation shown and described with respect to FIG. 2, the LDS laser beam dot size is 80 μm and is typically used with an overlap of 50% to ensure good lasering of the surface so that the pitch is 40 μm (i.e. half the laser beam dot size. Accordingly, a 0.5 mm track width would require approximately eight to nine (8-9) passes of the laser. The raster pattern may further include several vertically arranged passes (not shown) of the laser beam that may be utilized in order to, inter alia, build up the element 100 to target thickness (e.g., 0.5 mm to 1.5 mm in some implementations). Traversal of the individual raster pattern segments may take between e.g., 1 second to do from between thirty (30) square mm and sixty (60) square mm with a typical laser beam move speed of between 2600 mm/s to 3000 mm/s. It may therefore be advantageous to reduce antenna deposition time so as to reduce antenna cost and/or increase manufacturing throughput. In one variant of the present disclosure, this deposition time is reduced by obviating portions of the deposited antenna's surface area which are electrically "unnecessary". Moreover, cost reduction during the actual plating process by using the lasering processes discussed herein have negligible cost reductions for typical Cu/Ni plating as more chemicals are wasted in the plating process than are actually used to plate. Meaningful reduction is achieved from products that require Au plating.

FIG. 1B illustrates a reduced metal surface area planar antenna element in accordance with one implementation of the present disclosure. The antenna element 110 is characterized by an outline 112 (shown by a bold line in FIG. 1B) purely for purposes of illustration. Portions of the antenna 110 metal surface within the outline 112 may be removed (e.g., the portion 118). The antenna 110 may comprise one or more conductive portions (e.g., 116) separated by the metal-free non-conductive (e.g., "blank") portions 118. The metal portions (e.g., 116) of the antenna radiator 110 may be interconnected by conductive crosslinks 120. The antenna may be coupled to radio electronics at one or more connection points, e.g., 122 in FIG. 1B. At least one of a size and/or a placement of the crosslinks 122 may be configured based on distance from the connecting point 122. The antenna structure 110 may be referred to as the crosshatch and/or X-hatch structure.

It will be appreciated that in certain embodiments, the underlying preparation for metallization is applied to the entire surface area subsumed by the antenna radiator (and other components, such as feeds, etc.), yet the metallization of that area is only applied selectively to a smaller portion thereof. For example, in one LDS-based variant, the entire surface area circumscribed by the border of an antenna radiator is made capable of being laser activated, yet the laser activation is actually only applied to a portion of that area (e.g., corresponding to the exemplary cross-hatch pattern described elsewhere herein). This approach may be useful where, e.g., it is more costly to accurately define the shape of the ultimate antenna radiator that will be metalized in the substrate, and hence easier and less costly to merely prepare the whole area for possible activation/metallization, and then selectively activate and/or metalize to form the desired final radiator pattern. This logic can be applied to literally any step of the formation process as desired; i.e., where cost and/or material efficiencies are best served by only accurately defining the final radiator pattern where absolutely necessary. For instance, a final or top coating over the top of the radiator may be applied over the entire area (as opposed to having to mask or otherwise specifically delineate the radiator pattern) without affecting the electrical performance of the radiator.

During fabrication of the antenna 110 using, e.g., DLMS, a laser beam may be moved in a raster pattern within the antenna outline 112. The exemplary pattern is shown by the lines 114 in FIG. 1B. Comparing the reduced metal surface area antenna structure 110 the antenna structure of the prior art (e.g., the structure 100 of FIG. 1A), it may be seen that the pattern 114 of the antenna 110 may be manufactured using, e.g., fewer passes of a laser beam, thereby reducing antenna fabrication time using metal deposition processes.

In one exemplary embodiment, the antenna structure 110 may be formed onto a substrate via a deposition process that uses a Plowable conductive liquid, e.g., as described in U.S. patent application Ser. No. 13/782,993 entitled "DEPOSITION ANTENNA APPARATUS AND METHODS" filed Mar. 1, 2013), incorporated supra. A described in the above-referenced application, a conductive liquid may deposited onto a substrate in a desired thickness and according to a target pattern (e.g., the pattern of the structure 110), so as to form a radiating/receiving antenna structure directly on the substrate. Reducing the surface area that is to be covered by the conductive material (e.g., by removing portions 118), antenna manufacturing time and material needed may be reduced, compared to the antenna design of FIG. 1A The deposited conductive material is then cured (using e.g., electromagnetic radiation, heat, and/or chemical process) so as to render the conductive fluid mechanically stable, notably without any subsequent process steps such as plating.

FIG. 2 illustrates an antenna apparatus with reduced metal surface area in accordance with one implementation. The antenna apparatus 200 includes in one embodiment an antenna structure 210 disposed on a three-dimensional substrate 220. The structure 210 may include one or more connection structures, e.g., the feed structure 202 and a ground structure 204 as shown in FIG. 2. The antenna 210 may be configured to operate in one or more frequency bands. In some implementations, antenna operational bands may comprise a lower frequency band and an upper frequency band, such as e.g., those useful within one or more cellular or other wireless standards as described elsewhere herein. For example, the first antenna radiator portion 212 may be configured to support antenna operation in an upper frequency band, while the second antenna radiator portion 208 may be configured to support antenna operation in a lower frequency band.

As shown in FIG. 2, individual antenna portions may be disposed one or more surfaces, e.g., the portions 216, 202, 206, 212 disposed on the upper surface, while the radiator portion 208 is disposed on a (bottom) surface of the substrate 220. The lower and/or the upper frequency bands may comprise one or more individual bands configured to support one or more communications standards (e.g., Global System for Mobile Communications (GSM), Long Term Evolution (LTE), Wideband Code Division Multiple Access (W-CDMA), Code Division Multiple Access (CDMA), and/or other standards. For example, in one or more implementations, the lower frequency band may comprise one or more of the following: LTE 12 (698-746 MHz), LTE 17 (704 MHz to 746 MHz), LTE 13 (746 MHz to 787 MHz), LTE 14 (758 MHz to 798 MHz), LTE 20 (791 to 862 MHz), GSM850 (824 MHz to 894 MHz), E-GSM-900 (880 MHz to 960), and/or other bands. The upper frequency band may comprise e.g., one or more of the following: DCS 1800 (1710 MHz to 1880 MHz), PCS1900 (1850 MHz to 1990 MHz), WCDMA1 (1920 MHz to 2170 MHz), LTE 7 (2500 MHz to 2690 MHz) and/or other bands. Mixtures of different cellular standards (e.g., a lower band associated with one standard, and a comparatively higher frequency band for another standard), as well as cellular and non-cellular standards (or two non-cellular standards, such as Bluetooth and Wi-Fi, or Wi-Fi and GPS), are also contemplated.

The antenna structure 210 may be implemented using the exemplary reduced surface metal area methodology, e.g. such as described above with respect to FIG. 1B. The radiator portion of the antenna structure 210 may comprise one or more cross-hatch structures, wherein the conductive portions (e.g., 216) are separated by metal-free portions (e.g., 218). As used herein, the term "cross-hatch" refers without limitation to any configuration of two or more conductive traces or paths with at least a portion of the area in-between removed or not metalized. For example, the term may be applied to a lattice, repeating or non-repeating removal or non-metallization pattern (e.g., circular, polygonal, elliptical, etc.), or yet other variants.

In the exemplary embodiment, a plurality of crosslink elements (e.g., 206) are disposed to connect the one or more conductive portions. In some implementations, crosslink size, shape, and/or placement may be configured based on one or more factors, such as e.g., distance from the connecting point (e.g., 204). Particularly, it has been recognized by the inventors of the present disclosure that the placement of the crosslink element(s) relative to the connecting point can affect antenna performance. For example, the crosslink elements can typically start a minimum distance of 8 mm from the antenna/feed/ground point(s). In one or more implementations, crosslink 206 size and/or placement is configured to provide a prescribed current flow within the antenna 200. It has been found by the Assignee hereof that the distance of the crosslinks must be smaller than lambda/4 at the highest operating frequency of the antenna in order to avoid any unwanted slot resonances.

By employing the aforementioned exemplary "cross-hatch" design, total metal surface area of the antenna structure 210 may be significantly reduced; e.g., from 189.4 $mm^2$ (for a solid metal surface antenna design absent metal free portions 218 in FIG. 2) to 118.8 $mm^2$. This represents a 60% reduction in the metal surface area of the exemplary antenna. Fabrication time of the antenna structure 210 may be reduced accordingly when using LDS manufacturing methodology characterized, e.g., by the laser beam footprint width of 0.5 mm. For example, a laser beam may be moved in a raster pattern within the outline of the antenna structure 210. Reduction of the metal surface area of the antenna structure 210 (compared to the solid antenna design structure of the prior art) may reduce time and/or cost of the antenna 200 and/or increase manufacturing throughput.

Exemplary Mobile Device Configuration

Figure 3:
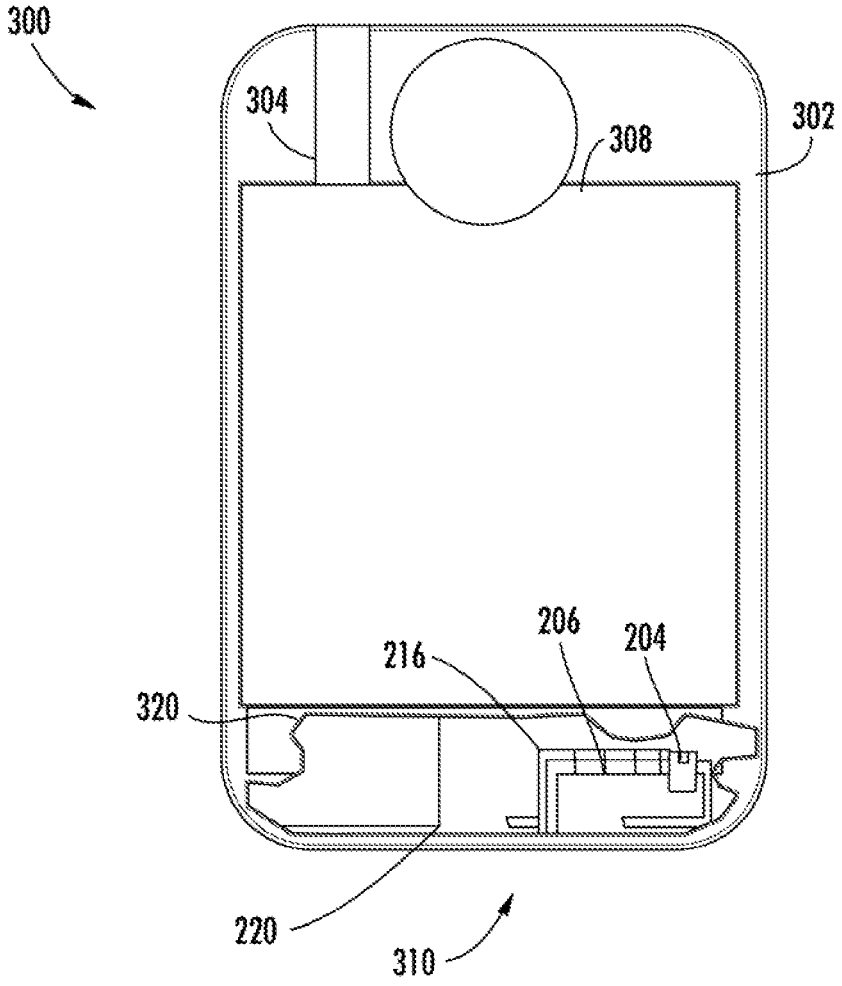
FIG. 3 is graphical illustration depicting a mobile communications device comprising the reduced-area antenna structure configured in accordance with the implementation shown in FIG. 2.

FIG. 3 illustrates one embodiment of a mobile communications device comprising the reduced-area antenna structure configured in accordance with the implementation shown in FIG. 2. The mobile apparatus 300 includes the reduced metal area antenna 310 disposed on the substrate 220, within the device enclosure 302 (here, at the bottom of the device, although any number of locations and orientations are possible. The antenna 310 may be coupled to a radio frequency driver or transceiver 320. The device may furtherer include other components such as e.g., a camera 308, a battery 306, an audio connector 304, and/or other components (e.g., processing electronics, user interface device).

One or more antenna 310 portions disposed within each of a number of different planes of the substrate 220; e.g., a plane parallel to the device main plane (e.g., the battery 306 plane), and a plane arranged perpendicular to the device main plane.

Figure 4:
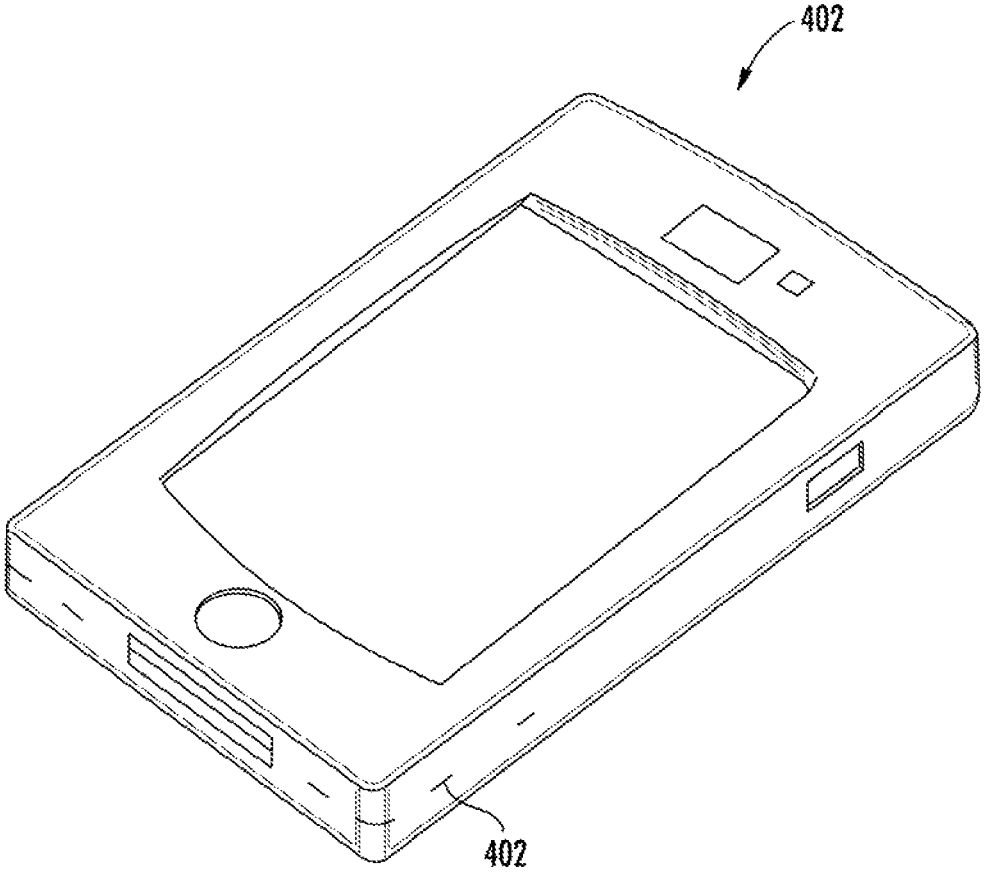
FIG. 4 is a perspective exterior view of one embodiment of a portable radio device illustrating placement of an exemplary reduced area antenna therein.

FIG. 4 is a perspective view of one embodiment of a portable radio device (e.g., smartphone) 402, illustrating the placement of an exemplary reduced area antenna 400 therein (shown as a dotted line so as to reflect the fact that the antenna may be disposed at least partly underneath or within the outer edge surfaces of the device.

Moreover, while exemplary embodiments herein are described primarily in terms of mobile devices, the apparatus and methods of the disclosure are in no way so limited, and may in fact be applied to any radio device which uses an antenna, whether fixed, mobile, semi-mobile, or otherwise.

As is well known, high-volume consumer devices such as smartphones may comprise any number of different form factors, including for example: (i) a substantially planar device with touch-screen display (FIG. 4); (ii) a "candy bar" type; (iii) a slide-out or fold-out keyboard device (not shown), and/or other configurations. The antenna apparatus and methods of the present disclosure are particularly well suited to such high-volume consumer devices, since they afford an appreciable manufacturing cost savings (thereby making for reduced device prices). Likewise, the antennas disclosed herein may be readily applied to tablets, handheld computers, gaming devices, "smart" TVs/remotes, smart watches, or any number of other electronic devices.

Development

Figure 5:
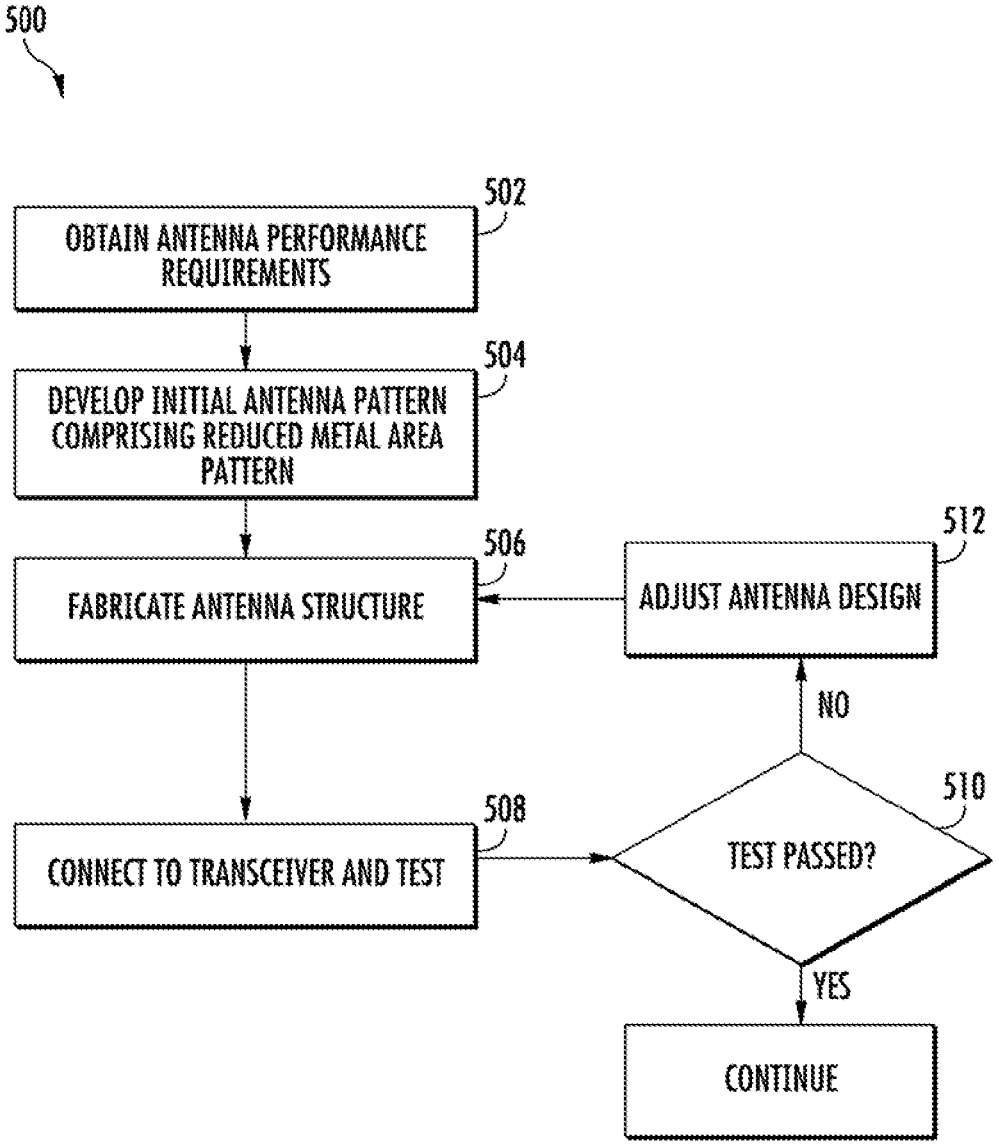
FIG. 5 is a logical flow diagram illustrating one embodiment of a generalized method of development testing of the reduced area antenna of the disclosure.

FIG. 5 is a logical flow diagram illustrating one embodiment of a generalized method of development testing of the reduced metal area antenna of the disclosure.

As will be appreciated by those of ordinary skill in the antenna arts, significant trial-and-error in terms of physical implementations of an antenna may be often required, due in part to factors such as imperfections in materials, imperfections in computerized antenna modeling software, and unknown or unanticipated effects from components present in the production device (e.g., metallic components such as frames, buttons, wires, etc.). Stated simply, the assembled device may not operate exactly as anticipated by modeling, or even as expected based on earlier tests performed when the device was not assembled.

Moreover, even after the device has been assembled, effects of other factors such as the placement of the user's hand, proximity to the user's head, etc. may impact the efficacy or operation of the antenna.

Hence, in another aspect, the present disclosure may advantageously reduce manufacturing time, thereby facilitating faster prototyping, tuning and testing of various antenna configurations to a level which may not be readily achievable with prior art technologies. Specifically, the present disclosure allows, in one exemplary approach, the ability to readily manufacture multiple antenna patterns, shapes, widths, thicknesses, cross-hatch patterns, so as to e.g., evaluate the effects thereof on antenna performance, and/or perform sensitivity analysis for the various parameters.

At step 502 of method 500, one or more antenna performance requirements may be obtained. In some implementations, the requirements may include antenna total efficiency, operating bands, size, return loss in one or more bands, manufacturing time, band isolation, and/or other antenna characteristics.

At step 504 of method 500, an initial antenna configuration may be developed. In some implementations, the initial configuration may comprise e.g., a portion of the antenna outline 122, size and/or placement of crosslinks 120 in FIG. 1B. The configuration or portions thereof may be obtained through e.g., "intelligent guessing" and/or prior knowledge of behavior based on, inter alia, the requirement(s) identified in step 502, computer model in or simulation, and/or other approaches.

At step 506 antenna structure is fabricated. The fabrication may be effectuated using, e.g., an additive manufacturing technology (e.g., LDS, or Plowable conductive deposition, vapor deposition, etc.). Moreover, it will be recognized that the structure need not necessarily be finally manufactured, but rather need only replicate a production device in critical attributes that may affect performance. For instance, one or more processing steps (such as curing, protective coatings, etc.) used in manufacturing the production antenna structure may be obviated to save prototyping time/cost if they do not have any bearing on electrical performance.

At step 508 of method 500, the fabricated antenna may be connected to a transceiver or other operational element, and tested. In one or more implementations, the antenna tests may include determination of antenna efficiency, response, directionality, etc., such as described below with respect to FIGS. 7A-7B.

At step 510 of method 500, a determination may be made as to whether the test results match, or are otherwise sufficient for, the target requirement(s) established e.g., at step 502.

Responsive to a determination that the test results do not match or are otherwise insufficient for the target requirement(s), the method 500 proceeds to operation 512, wherein antenna design is adjusted. In one or more implementations, the design adjustment may comprise modifying size, shape, and/or position of antenna metal portions (e.g., 116) and/or metal-free portions (e.g., 118 in FIG. 1B), and/or the crosslinks (e.g., 120). For example, the placement and/or number of cross-links may be changed. Additionally (or alternatively), the size and/or shape of the metal-free portions can be altered. Subsequent to these antenna design modifications being identified, the method 500 may proceed to step 506, wherein a revised antenna component is fabricated and tested, and the process 500 iterates as necessary until the desired test/target criteria are satisfactorily met.

Performance

Figure 6B:
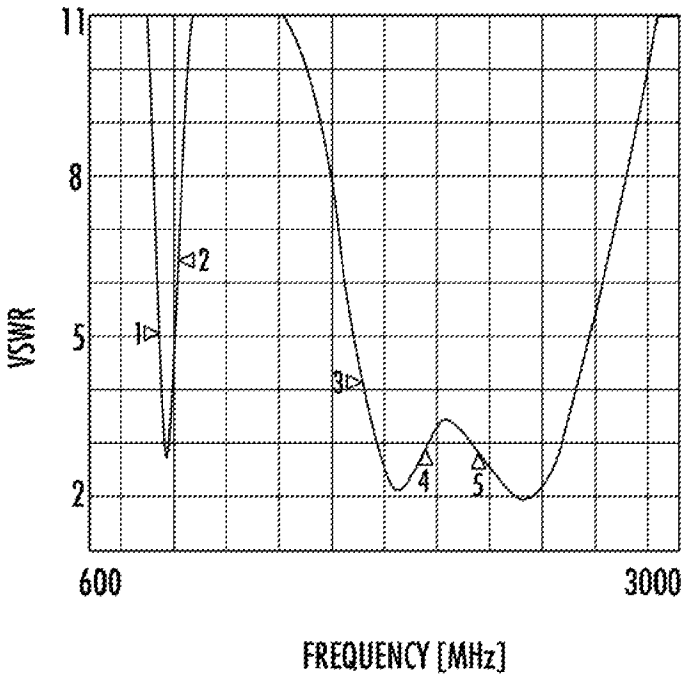
FIGS. 6A, 6B and 7 illustrates exemplary performance data obtained by the Assignee hereof in prototype testing of various aspects of the disclosure.
Figure 6A:
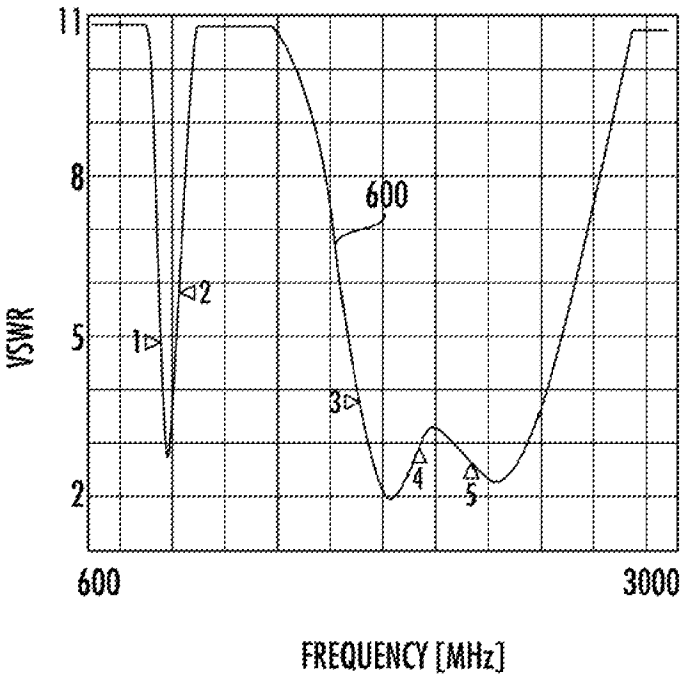
Figure 7:
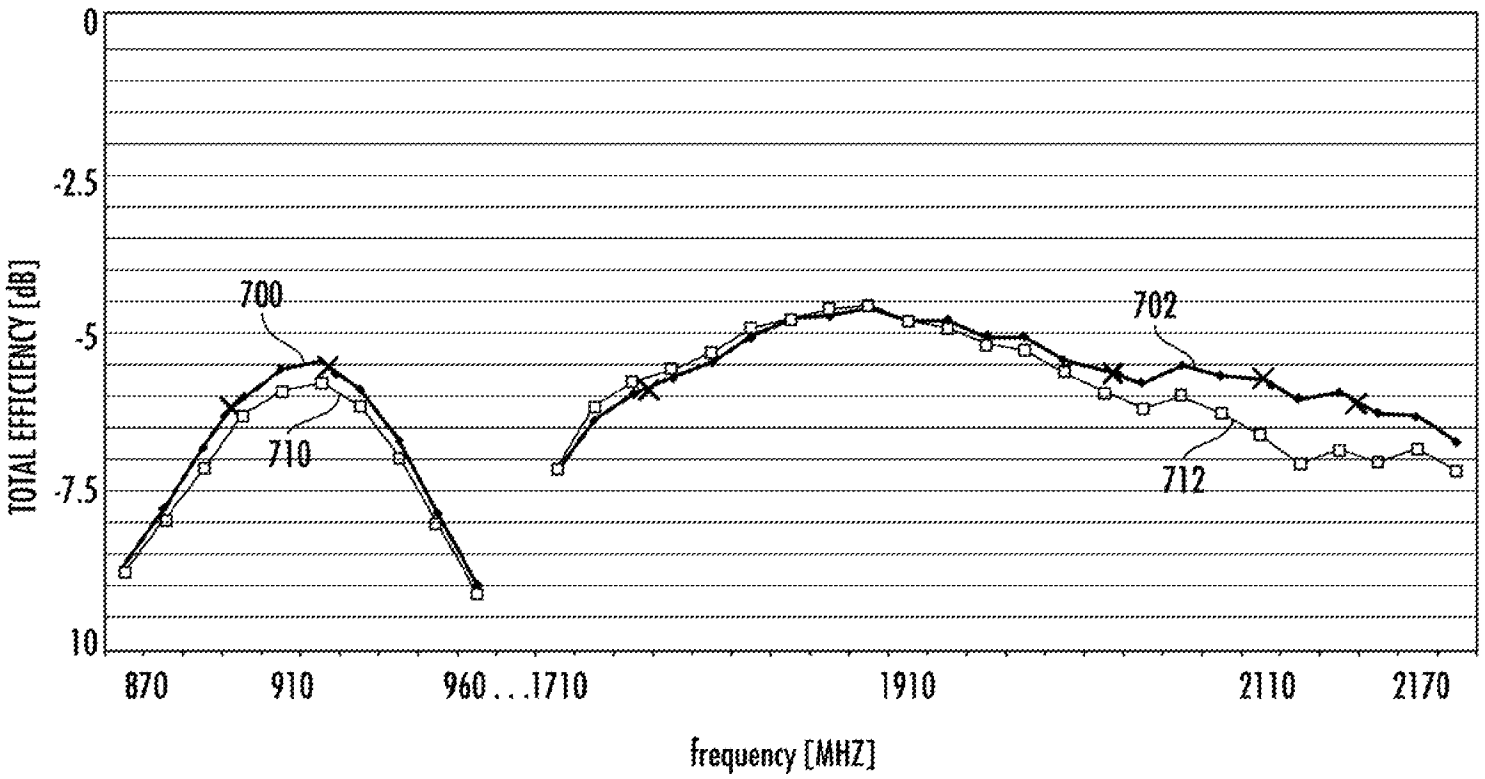

Referring now to FIGS. 6A-7, performance results obtained during testing by the Assignee hereof of exemplary antenna apparatus constructed according to the disclosure are presented.

Data presented in FIG. 6A depict free-space voltage standing wave ratio (VSWR) (in dB) as a function of frequency for the exemplary cross-hatch antenna design shown in FIG. 2. Data presented in FIG. 6B depict free-space VSWR as a function of frequency for a solid metal antenna (i.e., non cross-hatch) design corresponding to the cross-hatch antenna of FIG. 2. Comparison of curves 600 and 602 in FIGS. 6A-6B confirms that the exemplary embodiment of the cross-hatch antenna structure of the present disclosure is capable of matching the electrical performance of a solid metal surface antenna design, while providing the appreciable manufacturing, cost, and other benefits discussed previously herein.

FIG. 7 presents data regarding free-space efficiency obtained for the antenna configurations described above with respect to FIGS. 6A-6B. Efficiency of an antenna (in dB) is may be defined decimal logarithm of a ratio of radiated to input power:

$$AntennaEfficiency = 10\log_{10}\left(\frac{\text{Radiated Power}}{\text{Input Power}}\right) \quad \text{(Eqn. 1)}$$

An efficiency of zero (0) dB corresponds to an ideal theoretical radiator, wherein all of the input power is radiated in the form of electromagnetic energy.

Curves marked with designators 710, 712 denote data obtained with the exemplary cross-hatch antenna design shown in FIG. 2 in a lower frequency band and upper frequency band, respectively. Curves marked with designators 700, 702 and the marker 'x' denote data obtained with the solid metal antenna design corresponding to the cross-hatch antenna of FIG. 2 in the lower and the upper frequency bands, respectively. Comparing antenna efficiency data shown by the curve 700 and the curve 710, it may be seen that the exemplary cross-hatch antenna structure of the present disclosure is capable of matching the traditional full metal surface antenna efficiency to within 0.5 dB over frequency range between 870 MHz and 960 MHz. Similarly, comparing data shown by the curve 702 and the curve 712, it may be seen that the exemplary cross-hatch antenna structure of the present disclosure is further capable of matching the traditional full metal surface antenna efficiency to within 0.25 dB over frequency range between 1710 MHz and 1920 MHz, and to within 1 dB over frequency range between 1920 MHz and 2170 MHz.

The present disclosure provides, inter alia, an antenna structure configured with a cross-hatch pattern, wherein a portion of the antenna surface metal may be eliminated. As discussed above, strategically placed crosslinks or other similar elements may be utilized in order to provide for a prescribed current flow within the antenna. Reducing antenna solid metal surface area (e.g., by 60% in some implementations) advantageously enables substantial reduction of the antenna fabrication time using additive manufacturing processes (e.g., LDS or deposition) as compared to the "full metal" antenna design of the prior art.

The antenna design methodology described herein reduces antenna manufacturing cost without sacrificing antenna performance. Test results confirm that removal/elimination of solid metal portions from the antenna surface, when accompanied by appropriately sized and placed cross-links or comparable elements, does not materially degrade antenna performance and moreover, the design/prototyping process may be significantly facilitated as well.

It will be recognized that while certain aspects of the disclosure are described in terms of a specific sequence of steps of a method, these descriptions are only illustrative of the broader methods of the disclosure, and may be modified as required by the particular application. Certain steps may be rendered unnecessary or optional under certain circumstances. Additionally, certain steps or functionality may be added to the disclosed embodiments, or the order of performance of two or more steps permuted. All such variations are considered to be encompassed within the disclosure and claims herein.

While the above detailed description has shown, described, and pointed out novel features of the disclosure as applied to various embodiments, it will be understood that various omissions, substitutions, and changes in the form and details of the device or process illustrated may be made by those skilled in the art. The foregoing description is of the best mode presently contemplated. This description is in no way meant to be limiting, but rather should be taken as illustrative of the general principles of the disclosure.

What is claimed is:

1. An antenna apparatus with a reduced metal surface area, comprising:

an antenna structure disposed on a three-dimensional substrate, the antenna structure, comprising:

three or more discrete conductive connection structures; and a radiator portion comprising one or more cross-hatch structures, the radiator portion comprising:

an outline structure configured to define a conductive closed-loop external periphery for the radiator portion;

a plurality of conductive portions disposed within the conductive closed-loop external periphery, a first portion of the plurality of conductive portions being separated from a second portion of the plurality of conductive portions by a plurality of non-conductive portions that are also disposed within the external periphery, the first portion and the second portion being interconnected by the three or more discrete conductive connection structures.

2. The antenna apparatus of claim 1, wherein at least a portion of the three or more discrete conductive connection structures comprises a feed structure and a ground structure.

3. The antenna apparatus of claim 2, wherein the antenna structure is configured for operation in a plurality of frequency bands, the plurality of frequency bands comprising an upper frequency band and a lower frequency band.

4. The antenna apparatus of claim 1, wherein the one or more cross-hatch structures comprises:

a first branch and a second branch;

wherein the three or more discrete conductive connecting elements are disposed substantially between the first and the second branches.

5. The antenna apparatus of claim 4, wherein at least one of a size and/or a placement of the first and the second branches is configured based on a distance from at least one of the three or more discrete conductive connection structures.

6. The antenna apparatus of claim 5, wherein at least a portion of the three or more discrete conductive connection structures comprise at least one of a feed structure and a ground structure.

7. The antenna apparatus of claim 6, wherein at least one of a size and/or a placement of at least one of the three or more discrete conductive connecting elements is configured based on a distance from at least one of the feed structure and the ground structure.

8. The antenna apparatus of claim 4, wherein a configuration of at least one of the three or more discrete conductive connecting elements is based at least in part on achieving a desired current flow.

9. The antenna apparatus of claim 1, wherein the radiator portion comprising the one or more cross-hatch structures, comprises:

a first radiator structure disposed on a first surface of the three-dimensional substrate; and a second radiator structure disposed on a second surface of the three-dimensional substrate, the first and second surfaces being different surfaces.

10. The antenna apparatus of claim 1, wherein the radiator portion comprising the one or more cross-hatch structures is configured to reduce a conductive surface area of the antenna structure as compared with an antenna structure with no cross-hatch structures.

11. A reduced-area antenna element, comprising:

an outline structure that defines a conductive closed-loop external periphery for the reduced-area antenna element;

a first radiating element having a first branch, a second branch, and a connecting point configured to connect the first branch and the second branch of the first radiating element, the first radiating element being disposed within the conductive closed-loop external periphery; and a plurality of connecting elements disposed substantially between the first and the second branches;

wherein the first branch and the second branch of the first radiating element are separated by a plurality of non-conductive blank portions and the plurality of connecting elements, the plurality of non-conductive blank portions also being disposed within the external periphery.

12. The antenna element of claim 11, wherein at least one of a size and/or a placement of the first and the second branches is configured based on a distance from the connecting point.

13. The antenna element of claim 11, wherein at least one of a size and/or a placement of at least one of the plurality of connecting elements is configured based on a distance from the connecting point.

14. The antenna element of claim 11, wherein a configuration of at least one of the plurality of connecting elements is based at least in part on achieving a desired current flow.

15. A mobile communications device, comprising:

a device enclosure and a substrate disposed within the device enclosure;

a radio transceiver; and a reduced-area antenna element disposed on the substrate, the reduced-area antenna element, comprising:

an outline structure that defines a conductive closed-loop external periphery for the reduced-area antenna element;

a first radiating element having first and second branches, and a connecting point, the first and second branches of the first radiating element being separated by a plurality of non-conductive portions, the first radiating element being disposed within the conductive closed-loop external periphery; and a plurality of connecting elements disposed at a plurality of corresponding locations substantially between the first and the second branches, the plurality of corresponding locations being determined by a respective distance of each connecting element from the connecting point, the plurality of connecting elements being disposed within the conductive closed-loop external periphery.

16. The mobile communications device of claim 15, wherein the reduced-area antenna element is constructed from a laser direct structuring (LDS) process.

17. The mobile communications device of claim 16, wherein at least one of a size and/or a placement of the first and the second branches is configured based on a distance from the connecting point.

18. The mobile communications device of claim 16, wherein a size of at least one of the plurality of connecting elements is configured based on a distance from the connecting point.

19. The mobile communications device of claim 16, wherein a configuration of at least one of the plurality of connecting elements is based at least in part on achieving a desired current flow.

20. The mobile communications device of claim 15, wherein the plurality of corresponding locations are selected so that a distance between a given connecting element and an adjacent connecting element is less than $\lambda/4$ at a highest operating frequency for the reduced-area antenna element.

* * * * *